US009822677B2

(12) United States Patent
Mori

(10) Patent No.: US 9,822,677 B2
(45) Date of Patent: Nov. 21, 2017

(54) VEHICLE BODY

(71) Applicant: HONDA MOTOR CO., LTD., Tokyo (JP)

(72) Inventor: Hidemichi Mori, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 171 days.

(21) Appl. No.: 14/959,872

(22) Filed: Dec. 4, 2015

(65) Prior Publication Data

US 2017/0159517 A1 Jun. 8, 2017

(51) Int. Cl.

| | |
|---|---|
| ***F01M 1/06*** | (2006.01) |
| ***F01M 9/10*** | (2006.01) |
| ***F01L 1/18*** | (2006.01) |
| ***F02F 1/24*** | (2006.01) |

(52) U.S. Cl.

CPC ..... *F01M 9/107* (2013.01); *F01L 1/181* (2013.01); *F02F 1/242* (2013.01); *F01L 2810/02* (2013.01)

(58) Field of Classification Search

CPC ..... F01M 9/107; F01L 2810/02; F01L 1/181; F02F 1/242

See application file for complete search history.

(56) References Cited

U.S. PATENT DOCUMENTS 6,276,320 B1 * 8/2001 Fujii ..... F01L 1/0532 123/90.16

2002/0053329 A1 5/2002 Takahashi et al.

FOREIGN PATENT DOCUMENTS

| | | |
|---|---|---|
| JP | 2001-182513 A | 7/2001 |
| JP | 2009-215923 A | 9/2009 |
| JP | 2010-163911 A | 7/2010 |

* cited by examiner

*Primary Examiner* — Zelalem Eshete

(74) *Attorney, Agent, or Firm* — Birch, Stewart, Kolasch & Birch, LLP

(57) ABSTRACT

An internal combustion engine with a reduced size while securing a sufficient amount of lubricating oil for rocker shafts in the internal combustion engine. A cam holder formed in a cylinder head extends from a rear wall portion of the cylinder head toward the attachment hole, and an intake-side downstream rocker shaft oil supply passage formed in a cross shape by causing two linear portions to intersect each other is formed inside the cam holder. In the intake-side downstream rocker shaft oil supply passage, one of the linear portions communicates with a left intake-side support hole located on a left side and configured to support a left intake-side rocker shaft, while the other one of the linear portions communicates with a right intake-side support hole located on a right side and configured to support a right intake-side rocker shaft.

20 Claims, 6 Drawing Sheets

VEHICLE BODY

BACKGROUND OF THE INVENTION

1. Field of the Invention

The present invention relates to an internal combustion engine.

2. Description of Background Art

An internal combustion engine is known that includes a structure wherein an oil supply passage extends across a cylinder block and a cylinder head branches at a wall portion of the cylinder head into an oil supply passage communicating with a support portion of a rocker shaft with an oil supply passage communicating with a support portion of a camshaft. See, for example, Japanese Patent Application Publication No. 2009-215923.

An internal combustion engine according to Japanese Patent Application Publication No. 2009-215923 is a diesel engine and a fuel injection valve is attached to communicate with a substantial center (top portion) of each of combustion chambers. This internal combustion engine is a four-valve engine with multiple intake and exhaust valves and multiple intake and exhaust rocker arms arranged side by side in an axial direction of each of the camshafts.

In the internal combustion engine, a space for forming the oil supply passage is limited because the shape of the cylinder head is complex and multiple members are provided in the cylinder head. Accordingly, when an oil supply passage capable of securing a sufficient amount of lubricating oil for the rocker shaft and the camshaft is to be formed, the oil supply passage becomes complicated and the passage length becomes long. The wall portion of the cylinder head needs to be made thick to secure the space for forming the oil supply passage. The internal combustion engine thus has a problem wherein it is difficult to secure a sufficient amount of lubricating oil and to reduce the size and the like at the same time.

More specifically, as in Japanese Patent Application Publication No. 2009-215923, when the internal combustion engine has a configuration in which the fuel injection valve is attached to the substantial center of the combustion chamber and the multiple rocker arms and the like are provided side by side in the axial direction of the camshaft, the oil supply passage branches to extend to a bearing portion of the camshaft and four points in support portions of the intake and exhaust rocker shafts located on both sides of the bearing portion in the axial direction of the camshaft. The oil supply passage is thus complicated and is long depending on portions to which the oil is supplied. The support portions of the rocker shafts are relatively thick in the axial direction of the camshaft.

Furthermore, although the internal combustion engine of Japanese Patent Application Publication No. 2009-215923 is a SOHC (Single OverHead Camshaft) engine, a DOHC (Double OverHead Camshaft) the engine requires that the oil supply passage should be formed while avoiding the fuel injection valve or a similar measure needs to be taken. Accordingly, the oil supply passage may become more complicated.

In an internal combustion engine using gasoline as fuel, an ignition plug is generally provided at the aforementioned position where the fuel injection valve is attached. As in the aforementioned diesel engine, this case also has a problem wherein it is difficult to secure a sufficient amount of lubricating oil and to reduce the size and the like at the same time when an oil supply passage capable of securing a sufficient amount of lubricating oil for the rocker shaft and the camshaft is formed.

SUMMARY AND OBJECTS OF THE INVENTION

The present invention has been made in view of the above. An object of an embodiment thereof is to provide an internal combustion engine which can secure a sufficient amount of lubricating oil for rocker shafts with a shape of an oil supply passage to the rocker shafts being simple and thereby reducing the size and the like while securing sufficient amount of lubricating oil for rocker shafts.

According to an embodiment of the present invention, an internal combustion engine includes a plurality of valves (14In) provided in a valve chamber (9) formed in a cylinder head (5); a cam holder (10) provided in the valve chamber (9); a camshaft (12In) rotatably supported by the cam holder (10) and having cams (15In) configured to open and close the plurality of valves (14In) via rocker arms (13In); an attachment hole (23) for an ignition plug or a fuel injection valve and the attachment hole (23) formed to communicate with a substantial center of a combustion chamber (8). Rocker shafts (20L, 20R) are configured to support the rocker arms (13In), the rocker shafts (20L, 20R) being parallel to a direction of an axis (C1) of the camshaft (12In) and arranged in a distributed manner on one side and another side of the attachment hole (23).

The internal combustion engine includes the cam holder (10) extending from a wall portion (5B) of the cylinder head (5) toward the attachment hole (23) with a downstream rocker shaft oil supply passage (32) formed in a cross shape by causing two linear portions (32A, 32B) to intersect each other being formed inside the cam holder (10). In the downstream rocker shaft oil supply passage (32), one of the linear portions (32A, 32B) extends toward the one side of the attachment hole (23) and communicates with a support hole (18L) located on the one side of the attachment hole (23) and configured to support the corresponding rocker shaft (20L), while the other one of the linear portions (32A, 32B) extends toward the other side of the attachment hole (23) and communicates with a support hole (18R) located on the other side of the attachment hole (23) and configured to support the corresponding rocker shaft (20R).

According to an embodiment of the present invention, the rocker shafts (20L, 20R) support the rocker arms (13In) on one side and another side of the attachment hole (23) in the direction of the axis (C1) of the camshaft (12In) in such a way that the rocker arms (13In) are swingable. The rocker arms (13In) are in contact with the plurality of valves (14In) arranged on the one side and the other side of the attachment hole (23) in the direction of the axis (C1) of the camshaft (12In). An upstream rocker shaft oil supply passage (30) extending in the direction of the axis (C1) of the camshaft (12In) is formed in the wall portion (5B) of the cylinder head (5). The downstream rocker shaft oil supply passage (32) extends from the upstream rocker shaft oil supply passage (30).

According to an embodiment of the present invention, the rocker shafts (20L, 20R) are arranged in a distributed manner on one side and another side of the attachment hole (23) in the direction of the axis (C1) of the camshaft (12In). The attachment hole (23) is provided to extend from the cam holder (10) to the combustion chamber (8), at least part of the attachment hole (23) is located between a connection portion between the support hole (18L) on the one side of the attachment hole (23) in the direction of the axis (C1) of the camshaft (12In) and the downstream rocker shaft oil supply passage (32) and a connection portion between the support hole (18R) on the other side and the downstream rocker shaft oil supply passage (32).

According to an embodiment of the present invention, a bearing portion (10In) of the camshaft (12In) is formed above a cross portion (Cr1) of the downstream rocker shaft oil supply passage (32) in the cam holder (10), and a cam oil supply passage (34) extending from the cross portion (Cr1) to the bearing portion (10In) is formed in the cam holder (10).

According to an embodiment of the present invention, an upstream oil supply passage (T3) is formed at least in the cylinder head (5), the upstream oil supply passage (T3) extending along a fastening member (62) provided to extend across a crankcase (3), a cylinder block (4) standing upright from the crankcase (3), and the cylinder head (5) standing upright from the cylinder block (4). The upstream rocker shaft oil supply passage (30) is connected to a downstream end portion of the upstream oil supply passage (T3) with the upstream rocker shaft oil supply passage (30) and the downstream rocker shaft oil supply passage (32) being formed on a plane orthogonal to the a cylinder center axis (S1).

According to an embodiment of the present invention, the internal combustion engine is a four-valve engine in which a plurality of valves are configured to open and close a single one of the combustion chamber (8) include two intake valves (14In) and two exhaust valves (14Ex). The rocker arms corresponding to the single combustion chamber (8) include two intake rocker arms (13In) configured to open and close the intake valves (14In) and two exhaust rocker arms (13Ex) configured to open and close the exhaust valves (14Ex). The camshaft includes an intake camshaft (12In) configured to swing the intake rocker arms (13In) and an exhaust camshaft (12Ex) configured to swing the exhaust rocker arms (13Ex), the intake rocker arms (13In) and the exhaust rocker arms (13Ex) are each orthogonal to a direction of an axis (C1, C2) of the intake camshaft (12In) or the exhaust camshaft (12Ex) and are arranged in a distributed manner on one side and another side of the attachment hole (23) in a direction orthogonal to a cylinder center axis (S1). The downstream rocker shaft oil supply passage includes an intake-side downstream rocker shaft oil supply passage (32) and an exhaust-side downstream rocker shaft oil supply passage (33).

According to an embodiment of the present invention, it is possible to distribute and supply the lubricating oil to the rocker shafts located on the one side and the other side of the attachment hole for the fuel injection valve or the ignition plug in the direction of the axis of the camshaft by using the simple-shaped downstream rocker shaft oil supply passage which is formed inside the cam holder and which has a cross shape. Since the downstream rocker shaft oil supply passage has the cross shape, it possible to make the passage lengths of the linear portions extending toward the one side and the other side of the attachment hole uniform and short, and to supply the lubricating oil to the rocker shafts located on the one side and the other side.

Due to this, in the internal combustion engine, while the shape of the oil supply passage to the rocker shafts is simple, it is possible to secure a sufficient amount of lubricating oil for the rocker shafts. Accordingly, size reduction and an improvement in production efficiency can be achieved while securing a sufficient amount of lubricating oil for the rocker shafts.

According to an embodiment of the present invention, the downstream rocker shaft oil supply passage can be connected to the support holes without interfering with the attachment hole. Providing the attachment hole closer to the rocker shafts can reduce a dimension of the cam holder in the extending direction thereof and reduce the size.

According to an embodiment of the present invention, the cam oil supply passage is formed to extend from the cross portion of the downstream rocker shaft oil supply passage where a cross-sectional area of the oil supply passage becomes smaller. This causes the lubricating oil to be evenly distributed to portions branching from the cross portion and extending downstream in the downstream rocker shaft oil supply passage and also facilitates supplying of the lubricating oil to the bearing portion. Thus, the camshaft can be preferably lubricated.

According to an embodiment of the present invention, since the shapes of the upstream rocker shaft oil supply passage, the downstream rocker shaft oil supply passage, and the upstream oil supply passage upstream of these oil supply passages are simple, the oil supply passages can be easily formed with the number of processing steps suppressed to a few steps.

According to an embodiment of the present invention, in the DOHC internal combustion engine, the lubricating oil can be preferably supplied from the cross-shaped downstream rocker shaft oil supply passage to the intake rocker shafts and the exhaust rocker shafts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention is described below by using the drawings.

Figure 1:
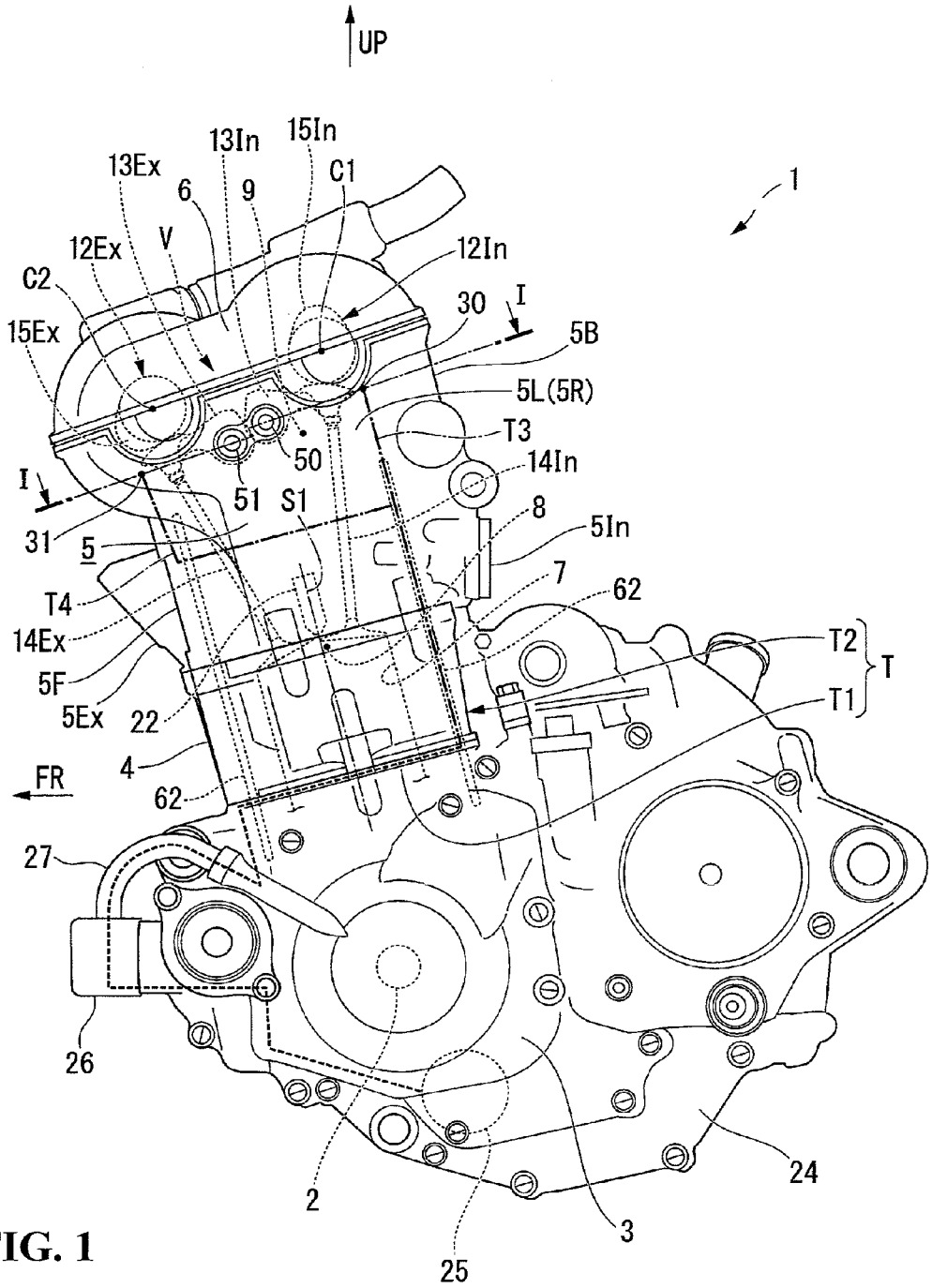
FIG. 1 is a left-side view of an internal combustion engine in an embodiment of the present invention.

FIG. 1 shows an internal combustion engine 1 in the embodiment of the present invention. In FIG. 1 and the drawings used in the below-mentioned description, FR shows a front side of the internal combustion engine 1, UP shows an upper side of the internal combustion engine 1, and LH shows a left side of the internal combustion engine 1. Note that these directions are specified for the convenience of description of the embodiment and the present invention is not limited by the directions of the embodiment.

The internal combustion engine 1 includes a crankshaft 2 arranged to extend in a left-right direction, a crankcase 3 housing, as an integral unit and a transmission configured to change the speed of the rotational motion transmitted from the crankshaft 2. A cylinder block 4 stands upright from an upper portion of the crankcase 3 to extend forward and upwardly with a cylinder head 5 standing upright from an upper portion of the cylinder block 4, and a head cover 6 covering an upper portion of the cylinder head 5 from above. In the embodiment, the crankcase 3, the cylinder block 4, and the cylinder head 5 are formed by casting.

In the embodiment, the internal combustion engine 1 is assumed to be mounted on a motorcycle. However, the internal combustion engine of the present invention is not limited to an engine mounted on the motorcycle.

The internal combustion engine 1 is a four-valve four-cycle single cylinder DOHC engine and one cylinder bore 7 is formed in the cylinder block 4. Note that reference numeral S1 in the drawing denotes a cylinder center axis passing through the center of a circular cross section of the cylinder bore 7.

A piston omitted in the drawings is fitted to the cylinder bore 7 to be capable of reciprocating. One end of a connection rod omitted in the drawings is connected to the piston and the other end of the connection rod is connected to the crankshaft 2. A combustion chamber 8 which is recessed upwardly, for example, in a dome shape is formed on a bottom surface of a bottom wall portion (not illustrated) of the cylinder head 5 which comes into contact with and faces the upper portion of the cylinder block 4.

A valve chamber 9 in which a valve train V is housed is formed above the bottom wall portion of the cylinder head 5 and the combustion chamber 8 described above is located below the valve chamber 9. The cylinder head 5 includes a front wall portion 5F, a rear wall portion 5B, a left wall portion 5L, and a right wall portion 5R and is formed to have a rectangular horizontal cross section (cross section in a direction orthogonal to the cylinder center axis S1). The front wall portion 5F, the rear wall portion 5B, the left wall portion 5L, and the right wall portion 5R are located outside the cylinder center axis S1 as viewed in the cylinder center axis S1 direction. The aforementioned bottom wall portion of the cylinder head 5 is formed inside a space surrounded by the front wall portion 5F, the rear wall portion 5B, the left wall portion 5L, and the right wall portion 5R. Note that, in FIG. 1, the reference signs of the right wall portion 5R not illustrated in the drawing is shown in parentheses for the sake of convenience.

In the drawings, an intake port 5In and an exhaust port 5Ex are provided. The intake port 5In extends from the rear wall portion 5B of the cylinder head 5 toward the combustion chamber 8 through the bottom wall portion of the cylinder head 5, and communicates with the combustion chamber 8 at two portions. Air-fuel mixture supplied to the combustion chamber 8 when the internal combustion engine 1 is driven passes through the intake port 5In.

Meanwhile, the exhaust port 5Ex extends from the front wall portion 5F of the cylinder head 5 toward the combustion chamber 8 through the bottom wall portion of the cylinder head 5, and communicates with the combustion chamber 8 at two portions. Exhaust gas exhausted from the combustion chamber 8 when the internal combustion engine 1 is driven passes through the exhaust port 5Ex.

In the embodiment, since the internal combustion engine 1 is a four-valve engine, each of the intake port 5In and the exhaust port 5Ex has two open ends communicating with the combustion chamber 8. Note that the bottom wall portion of the cylinder head 5 is formed to have a relatively large thickness in the cylinder center axis S1 direction because the combustion chamber 8 is formed in the bottom wall portion to be recessed and the intake port 5In and the exhaust port 5Ex are formed to penetrate the bottom wall portion.

Figure 2:
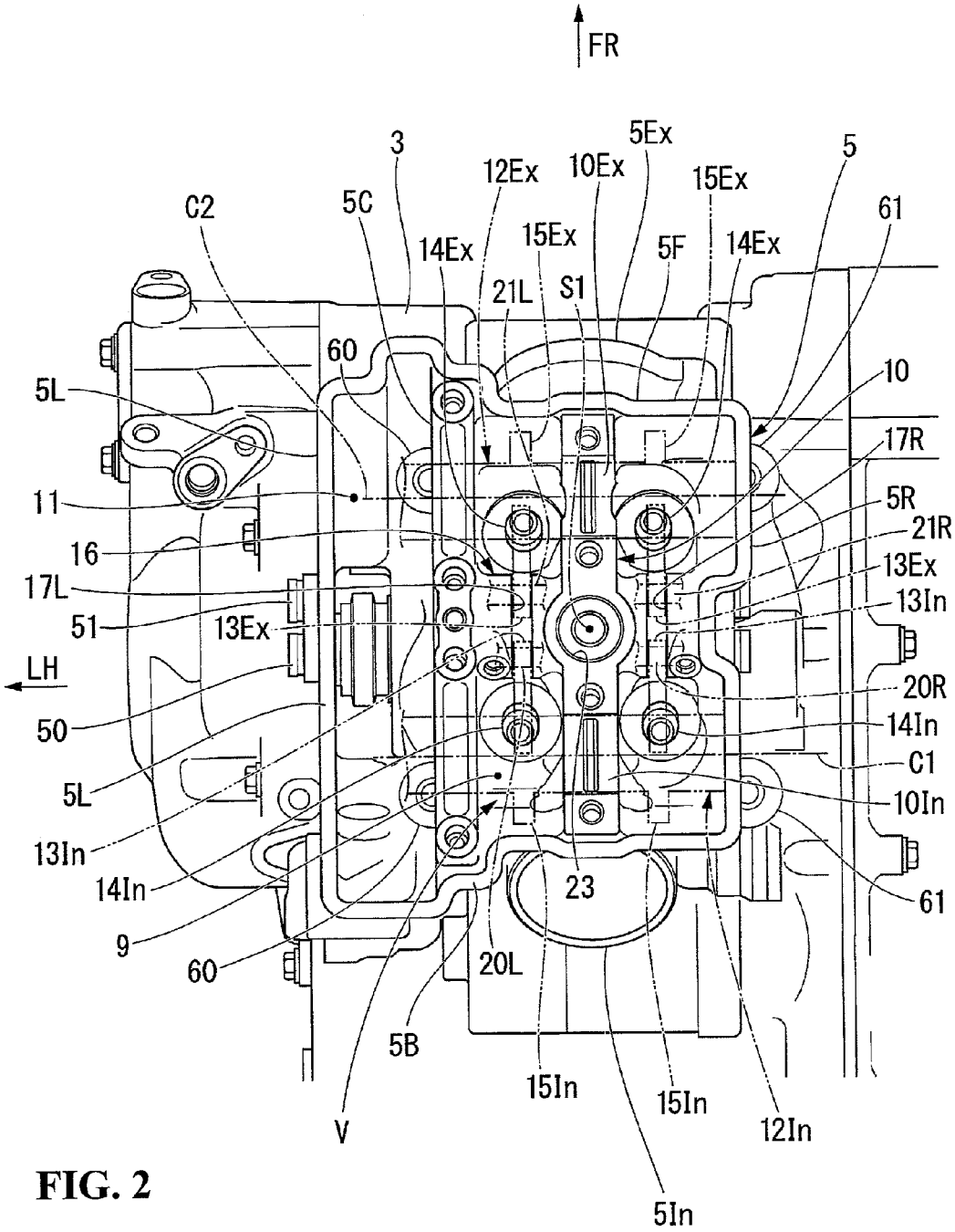
FIG. 2 is a view of a cylinder head of the internal combustion engine from above in a cylinder center axis direction.

FIG. 2 shows the inside of the cylinder head 5. Inside the cylinder head 5, a cam chain chamber forming wall portion 5C extending along the left wall portion 5L is formed on the right side of the left wall portion 5L. The cam chain chamber forming wall portion 5C extends between the front wall portion 5F and the rear wall portion 5B in the front-rear direction. As viewed in the cylinder center axis S1 direction, the inside of the cylinder head 5 is partitioned into the valve chamber 9 and a cam chain chamber 11 respectively on the right side and the left side of the cam chain chamber forming wall portion 5C.

More specifically, the valve chamber 9 is formed of the front wall portion 5F, the rear wall portion 5B, the right wall portion 5R, and the cam chain chamber forming wall portion 5C and a rectangular space is formed by a horizontal cross section (cross section in a direction orthogonal to the cylinder center axis S1) of the valve chamber 9. In addition, the cam chain chamber 11 is formed of the front wall portion 5F, the rear wall portion 5B, the left wall portion 5L, and the cam chain chamber forming wall portion 5C.

The cam chain chamber 11 communicates with the crankcase 3 through the cylinder block 4 and houses a not-illustrated cam chain. The bottom wall portion of the cylinder head 5 is open in a portion where the cam chain chamber 11 is formed.

Paired front and rear left fastening boss portions 60 are formed integrally with the cam chain chamber forming wall portion 5C by casting in the cam chain chamber 11, on the left side of the cam chain chamber forming wall portion 5C, inside the cylinder head 5. Paired front and rear right fastening boss portions 61 are formed integrally with the right wall portion 5R by casting on the right side of the right wall portion 5R, outside the cylinder head 5. A through hole extending along the cylinder center axis S1 is formed in each of the left fastening boss portions 60 and the right fastening boss portions 61.

A stud bolt 62 which is a fastening member shown in FIG. 1 is inserted into each of the paired front and rear left fastening boss portions 60 and the paired front and rear right fastening boss portions 61 and the cylinder head 5 is thus fastened to the cylinder block 4 and the crankcase 3 by the stud bolts 62. The four stud bolts 62 are each provided to extend across the crankcase 3, the cylinder block 4, and the cylinder head 5. When the cylinder head 5 is fastened to the cylinder block 4, the stud bolts 62 are fixed to the crankcase 3 to stand upright from the crankcase 3, and then sequentially inserted into the cylinder block 4 and the cylinder head 5 (the aforementioned fastening boss portions 60, 61).

Returning to FIG. 2, a cam holder 10 extending between the front wall portion 5F and the rear wall portion 5B in the front-rear direction is formed in the valve chamber 9 at a substantially center position thereof in the left-right direction. The cam holder 10 is formed integrally with the front wall portion 5F and the rear wall portion 5B by casting.

An intake camshaft bearing portion 10In and an exhaust camshaft bearing portion 10Ex are formed in the cam holder 10 to be arranged side by side in the front-rear direction. The intake camshaft bearing portion 10In is formed behind the exhaust camshaft bearing portion 10Ex. The intake camshaft bearing portion 10In and the exhaust camshaft bearing portion 10Ex are each formed in an arc shape protruding downwardly.

Referring to FIGS. 1 and 2, the valve train V includes an intake camshaft 12In supported by the intake camshaft bearing portion 10In described above, an exhaust camshaft 12Ex supported by the exhaust camshaft bearing portion 10Ex described above, paired intake rocker arms 13In configured to swing according to rotation of the intake camshaft 12In, paired exhaust rocker arms 13Ex configured to swing according to rotation of the exhaust camshaft 12Ex, paired intake valves 14In configured to operate according to the swinging of the intake rocker arms 13In, and paired exhaust valves 14Ex configured to operate according to the swinging of the exhaust rocker arms 13Ex.

Note that, in FIG. 2, the intake camshaft 12In, the exhaust camshaft 12Ex, the intake rocker arms 13In, and the exhaust rocker arms 13Ex are illustrated by two-dot chain lines for the sake of convenience.

The intake camshaft 12In and the exhaust camshaft 12Ex are supported by the cam holder 10 while extending across the valve chamber 9 and the cam chain chamber 11 in the left-right direction. To be more specific, the intake camshaft 12In and the exhaust camshaft 12Ex are held down from above by a not-illustrated holding member in which arc-shaped bearing portions are formed, while being placed on the intake camshaft bearing portion 10In and the exhaust camshaft bearing portion 10Ex, and are rotatably supported by the cam holder 10 and the holding member in a sliding bearing state.

In the drawings, a center axis C1 of the intake camshaft 12In and a center axis C2 of the exhaust camshaft 12Ex are provided. Note that, hereafter, the center axis C1 of the intake camshaft 12In is simply referred to as the axis C1 of the intake camshaft 12In and the center axis C2 of the exhaust camshaft 12Ex is simply referred to as the axis C2 of the exhaust camshaft 12Ex.

The cam chain described above is wound around portions of the intake camshaft 12In and the exhaust camshaft 12Ex which are located inside the cam chain chamber 11. The cam chain transmits rotation of the crankshaft 2 to the camshaft 12In and the exhaust camshaft 12Ex, and the intake camshaft 12In and the exhaust camshaft 12Ex rotate ½ revolution per one revolution of the crankshaft 2.

Paired intake cams 15In arranged side by side in the camshaft axis direction (left-right direction) are formed in a portion of the intake camshaft 12In which is located inside the valve chamber 9. In addition, paired exhaust cams 15Ex, arranged side by side in the camshaft axis direction (left-right direction), are formed in a portion of the exhaust camshaft 12Ex which is located inside the valve chamber 9. To be more specific, the paired intake cams 15In and the paired exhaust cams 15Ex are formed in a distributed manner on left and right sides of the cam holder 10.

The intake rocker arms 13In are in contact with the intake cams 15In and swing according to profiles of the intake cams 15In when the intake cams 15In rotate. Meanwhile, the exhaust rocker arms 13Ex are in contact with the exhaust cams 15Ex and swing according to profiles of the exhaust cams 15Ex when the exhaust cams 15Ex rotate.

Referring to FIGS. 2 to 5, a rocker arm holder portion 16 extending between the right wall portion 5R and the cam chain chamber forming wall portion 5C in a direction orthogonal to the cam holder 10 (left-right direction) is formed in the valve chamber 9. The intake rocker arms 13In and the exhaust rocker arms 13Ex are swingably supported by the rocker arm holder portion 16. Note that the rocker arm holder portion 16 is formed integrally with the right wall portion 5R, the cam chain chamber forming wall portion 5C, and the cam holder 10 by casting.

The rocker arm holder portion 16 extends in the left-right direction in a space between the intake camshaft 12In (intake camshaft bearing portion 10In) and the exhaust camshaft 12Ex (exhaust camshaft bearing portion 10Ex) as viewed in the cylinder center axis S1 direction. A left housing support groove 17L and a right housing support groove 17R which are recessed downwardly and are opened toward the intake camshaft 12In (rearwardly) and the exhaust camshaft 12Ex (forwardly) are formed respectively in sections of the rocker arm holder portion 16 which are on left and right sides of the cam holder 10.

Figure 5:
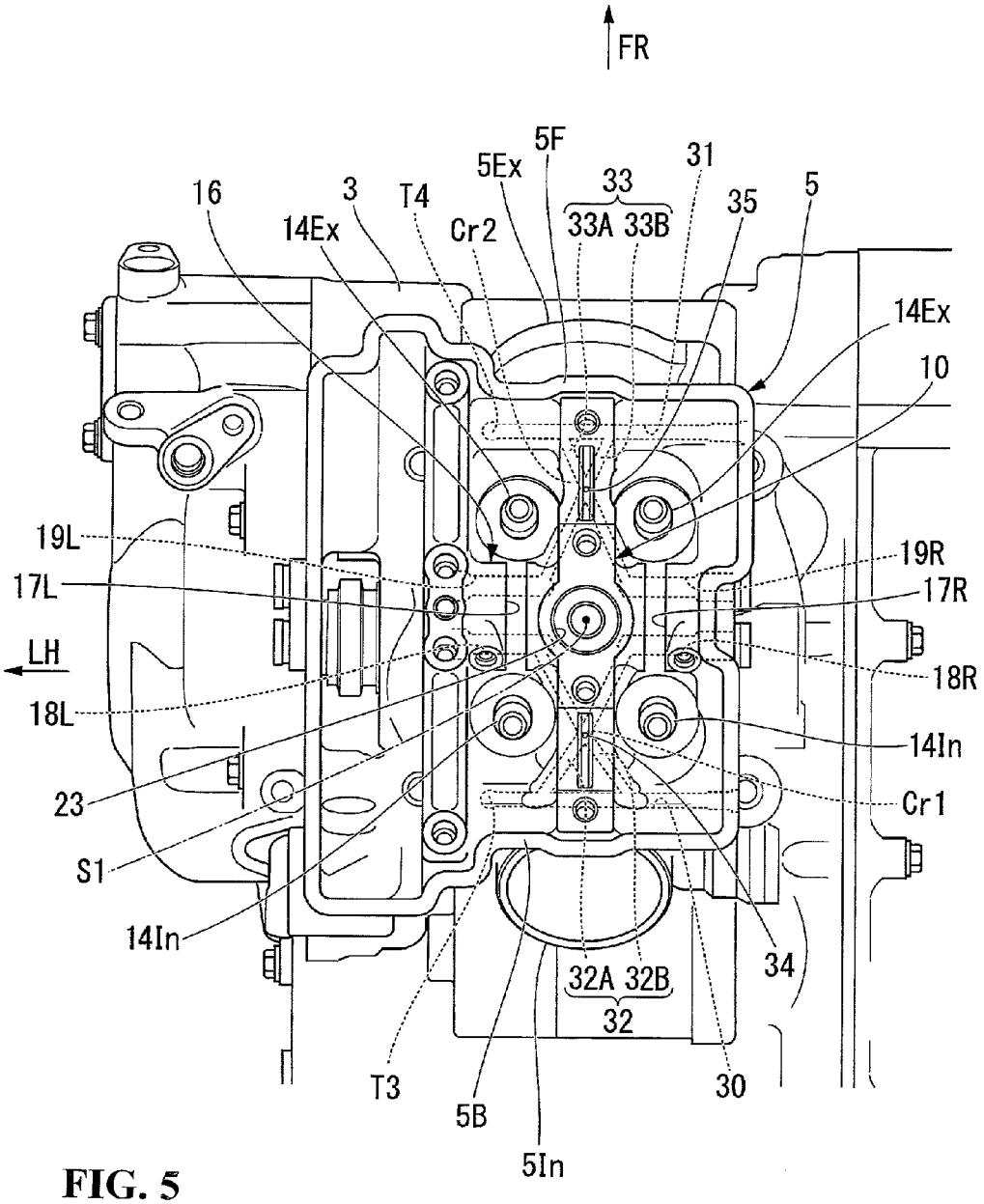
FIG. 5 is a view of the cylinder head of the internal combustion engine from above in the cylinder center axis direction with camshafts and rocker arms being removed.

Referring to FIGS. 2 and 5, one of the paired intake rocker arms 13In arranged on the left side is supported with one end portion thereof housed in a rear portion of the left housing support groove 17L and the other end portion thereof extending rearward. In addition, the other one of the paired intake rocker arms 13In, arranged on the right side, is supported with one end portion thereof housed in a rear portion of the right housing support groove 17R and the other end portion thereof extending rearwardly.

More specifically, as shown in FIG. 5, a left intake-side support hole 18L extending in the left-right direction across the left housing support groove 17L is formed in an intake camshaft 12In side portion of the section of the rocker arm holder portion 16 on the left side of the cam holder 10. In addition, a right intake-side support hole 18R extending in the left-right direction across the right housing support groove 17R is formed in an intake camshaft 12In side portion of the section of the rocker arm holder portion 16 on the right side of the cam holder 10. The left intake-side support hole 18L penetrates the cam chain chamber forming wall portion 5C and the right intake-side support hole 18R penetrates the right wall portion 5R.

Thereafter, referring to FIG. 2, a left intake-side rocker shaft 20L extending in the left-right direction is inserted into the left intake-side support hole 18L through the cam chain chamber forming wall portion 5C, and is inserted into the aforementioned one end portion of the intake rocker arm 13In arranged on the left side in such a way that the intake rocker arm 13In is supported to be swingable about the axis of the left intake-side rocker shaft 20L.

A right intake-side rocker shaft 20R extending in the left-right direction is inserted into the right intake-side support hole 18R through the right wall portion 5R, and is inserted into the aforementioned one end portion of the intake rocker arm 13In arranged on the right side in such a way that the intake rocker arm 13In is supported to be swingable about the axis of the right intake-side rocker shaft 20R. The left intake-side rocker shaft 20L and the right intake-side rocker shaft 20R extend parallel to the intake camshaft 12In.

Furthermore, referring to FIG. 5, a left exhaust-side support hole 19L extending in the left-right direction across the left housing support groove 17L is formed in an exhaust camshaft 12Ex side portion of the section of the rocker arm holder portion 16 on the left side of the cam holder 10. In addition, a right exhaust-side support hole 19R extending in the left-right direction across the right housing support groove 17R is formed in an exhaust camshaft 12Ex side portion of the section of the rocker arm holder portion 16 on the right side of the cam holder 10. The left exhaust-side support hole 19L penetrates the cam chain chamber forming wall portion 5C and the right exhaust-side support hole 19R penetrates the right wall portion 5R.

Then, referring to FIG. 2, a left exhaust-side rocker shaft 21L extending in the left-right direction is inserted into the left exhaust-side support hole 19L through the cam chain chamber forming wall portion 5C, and is inserted into the aforementioned one end portion of the exhaust rocker arm 13Ex arranged on the left side in such a way that the exhaust rocker arm 13Ex is supported to be swingable about the axis of the left exhaust-side rocker shaft 21L.

A right exhaust-side rocker shaft 21R extending in the left-right direction is inserted into the right exhaust-side support hole 19R through the right wall portion 5R, and is inserted into the aforementioned one end portion of the exhaust rocker arm 13Ex arranged on the right side in such a way that the exhaust rocker arm 13Ex is supported to be swingable about the axis of the right exhaust-side rocker shaft 21R. The left exhaust-side rocker shaft 21L and the right exhaust-side rocker shaft 21R extend parallel to the exhaust camshaft 12Ex.

As shown in FIGS. 1 and 2, in the left wall portion 5L in the cylinder head 5, an intake-side work hole 50 is formed to be coaxial to the left intake-side support hole 18L while an exhaust-side work hole 51 is formed to be coaxial to the left exhaust-side support hole 19L. In assembly of the left intake-side rocker shaft 20L and the left exhaust-side rocker shaft 21L, work is performed through the intake-side work hole 50 and the exhaust-side work hole 51.

A description is given of the intake valves 14In and the exhaust valves 14Ex with reference to FIG. 1. Each of the intake valves 14In and the exhaust valves 14Ex includes a valve head and a stem portion extending from the valve head. Each of the intake valves 14In advances and retreats in an axis direction of the stem portion thereof according to the swinging of the corresponding intake rocker arm 13In and each of the exhaust valves 14Ex advances and retreats in an axis direction of the stem portion thereof according to the swinging of the corresponding exhaust rocker arm 13Ex.

In each of the intake valves 14In, the aforementioned valve head is formed in a lower end portion and is disposed in the combustion chamber 8. In addition, an upper end portion of the stem portion is disposed in the valve chamber 9 and brought into contact with the aforementioned other end portion (end portion on a swinging side) of the corresponding intake rocker arm 13In. The intake valve 14In is disposed such that the stem portion is spaced away from the cylinder center axis S1 to the rear side as extends upwardly. The valve head of one of the paired intake valves 14In is configured to open and close one of the two open ends of the intake port 5In on the combustion chamber 8 side while the valve head of the other one of the paired intake valves 14In is configured to open and close the other one of the two open ends of the intake port 5In on the combustion chamber 8 side.

Similarly, in each of the exhaust valves 14Ex, the aforementioned valve head is formed in a lower end portion and is disposed in the combustion chamber 8. In addition, an upper end portion of the stem portion is disposed in the valve chamber 9 and brought into contact with the aforementioned other end portion (end portion on a swinging side) of the corresponding exhaust rocker arm 13Ex. The exhaust valve 14Ex is disposed such that the stem portion is spaced away from the cylinder center axis S1 to the front side as extending upward. The valve head of one of the paired exhaust valves 14Ex is configured to open and close one of the two open ends of the exhaust port 5Ex on the combustion chamber 8 side while the valve head of the other one of the paired exhaust valves 14Ex is configured to open and close the other one of the two open ends of the exhaust port 5Ex on the combustion chamber 8 side.

In the internal combustion engine 1, the engine is driven by repeating an intake stroke, a compression stroke, a combustion stroke, and an exhaust stroke. In the valve train V, when the intake stroke is started, the intake rocker arms 13In are swung downwardly by the intake cams 15In of the intake camshaft 12In to open the intake valves 14In. In the valve train V, when the exhaust stroke is started, the exhaust rocker arms 13Ex are swung downwardly by the exhaust cams 15Ex of the exhaust camshaft 12Ex to open the exhaust valves 14Ex.

In the internal combustion engine 1, ignition of air-fuel mixture compressed in the compression stroke is performed between the compression stroke and the combustion stroke and a cycle proceeds to the combustion stroke after the ignition. As shown in FIGS. 1 and 2, in the internal combustion engine 1 of the embodiment, an ignition plug 22 configured to ignite the air-fuel mixture at a predetermined timing is provided to communicate with a substantial center of the combustion chamber 8.

The substantial center of the combustion chamber 8 refers to a substantially-center portion of the substantially-circular combustion chamber 8 as viewed in the cylinder center axis S1 direction. In the embodiment, the substantial center of the combustion chamber 8 is located in a top portion of the combustion chamber 8 in the cylinder center axis S1 direction.

Figure 3:
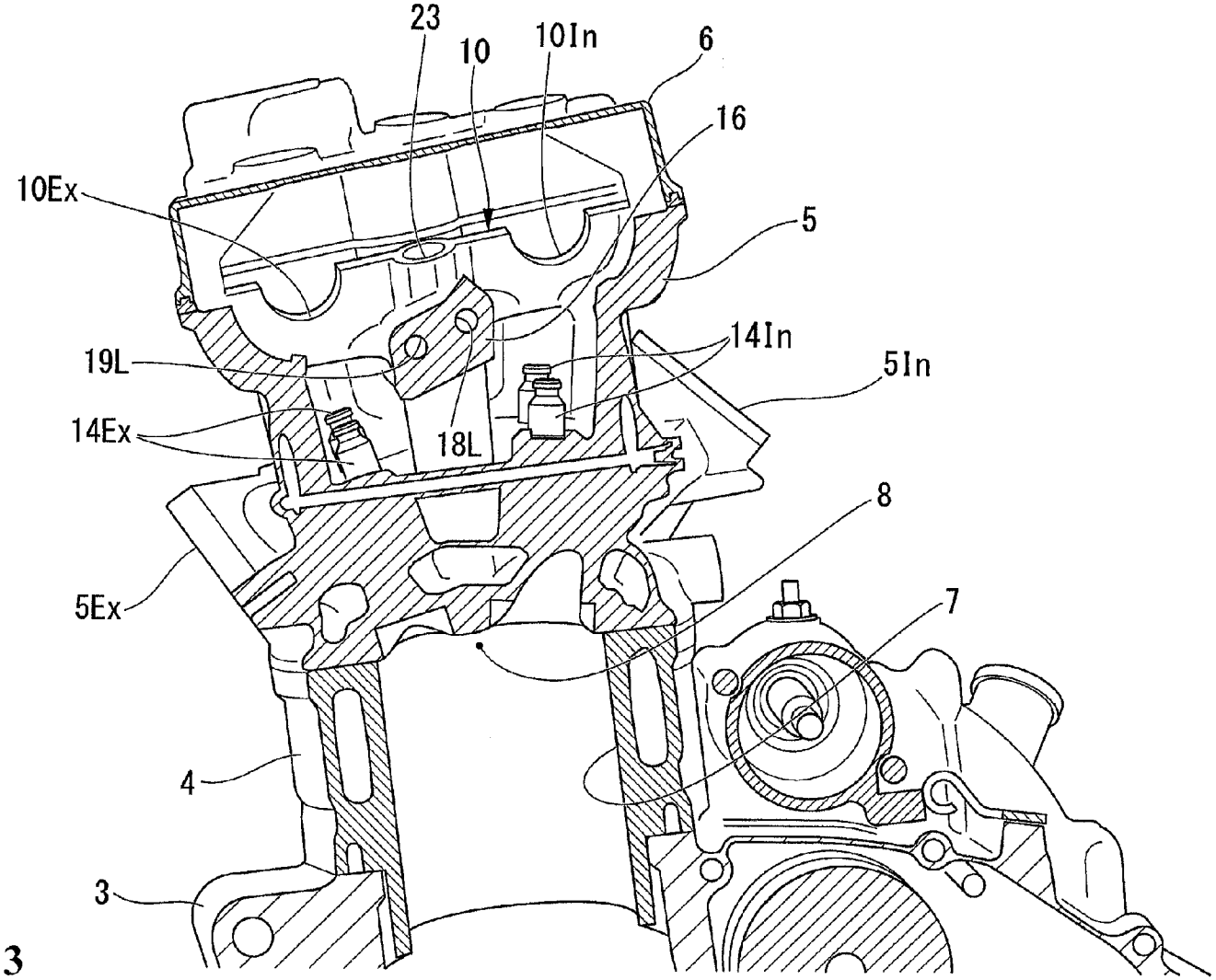
FIG. 3 is a bird's-eye-view in which a vertical cross section of the internal combustion engine along a front-rear direction is viewed downward from above.
Figure 4:
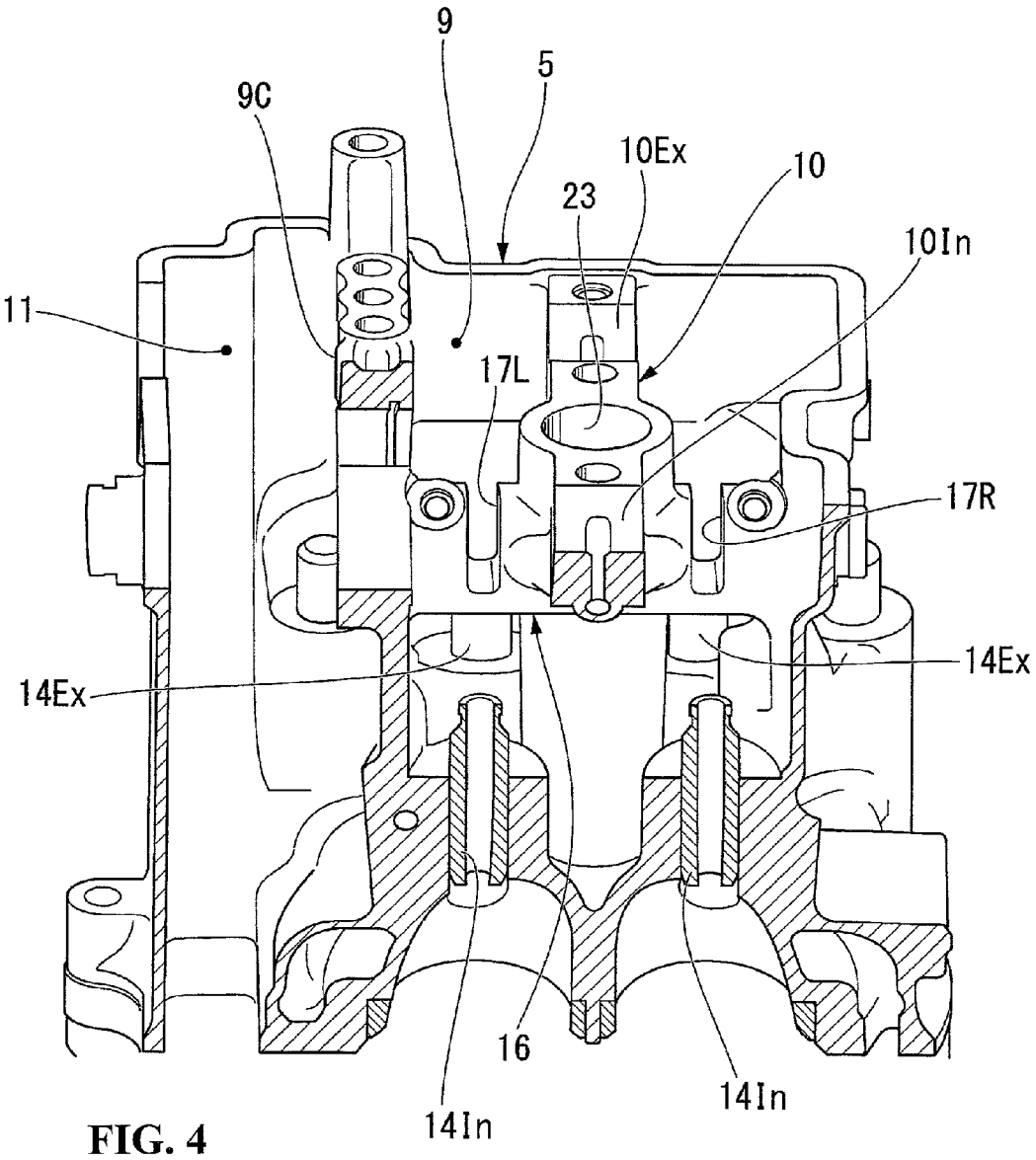
FIG. 4 is a bird's-eye-view in which a cross section of the internal combustion engine taken along an axis direction of valves arranged on a front side of the internal combustion engine is viewed downwardly from above.

As shown in FIGS. 2 to 4, an attachment hole 23 for the ignition plug 22 is formed in a center portion of the cam holder 10 in the front-rear direction. The attachment hole 23 extends from a top surface of the cam holder 10 to the combustion chamber 8 along the cylinder center axis S1 and communicates with the substantial center of the combustion chamber 8. In a case of attaching the ignition plug 22, the ignition plug 22 is inserted into the attachment hole 23 from above to face the combustion chamber 8.

Description is given of arrangement relationships among the attachment hole 23 and the parts forming the valve train V. The left intake-side rocker shaft 20L is arranged on the left side of the attachment hole 23 in the direction of the axis C1 of the intake camshaft 12In and the right intake-side rocker shaft 20R is arranged on the right side of the attachment hole 23 in the direction of the axis C1. On the left side of the attachment hole 23 in the direction of the axis C1 of the intake camshaft 12In, the left intake-side rocker shaft 20L supports one of the paired intake rocker arms 13In arranged on the left side in such a way that the intake rocker arm 13In is swingable. The intake rocker arm 13In arranged on the left side is in contact with the intake valve 14In located on the left side of the attachment hole 23.

On the right side of the attachment hole 23 in the direction of the axis C1 of the intake camshaft 12In, the right intake-side rocker shaft 20R supports one of the paired intake rocker arms 13In arranged on the right side in such a way that the intake rocker arm 13In is swingable. The intake rocker arm 13In arranged on the right side is in contact with the intake valve 14In located on the right side of the attachment hole 23.

Furthermore, the left exhaust-side rocker shaft 21L is arranged on the left side of the attachment hole 23 in the direction of the axis C2 of the exhaust camshaft 12Ex and the right exhaust-side rocker shaft 21R is arranged on the right side of the attachment hole 23 in the direction of the axis C1. On the left side of the attachment hole 23 in the direction of the axis C2 of the exhaust camshaft 12Ex, the left exhaust-side rocker shaft 21L supports one of the paired exhaust rocker arms 13Ex arranged on the left side in such a way that the exhaust rocker arm 13Ex is swingable. The exhaust rocker arm 13Ex arranged on the left side is in contact with the exhaust valve 14Ex located on the left side of the attachment hole 23.

On the right side of the attachment hole 23 in the direction of the axis C2 of the exhaust camshaft 12Ex, the right exhaust-side rocker shaft 21R supports one of the paired exhaust rocker arms 13Ex arranged on the right side in such a way that the exhaust rocker arm 13Ex is swingable. The exhaust rocker arm 13Ex arranged on the right side is in contact with the exhaust valve 14Ex located on the right side of the attachment hole 23.

Returning to FIG. 1, an oil pan 24 which is a separate body is provided in a lower portion of the crankcase 3 and an oil pump 25 configured to pump up lubricating oil accumulated in the oil pan 24 is provided inside the lower portion of the crankcase 3. An oil cooler 26 is provided in a front portion of the crankcase 3. In the internal combustion engine 1, the lubricating oil pumped up by the oil pump 25 is supplied to the cylinder head 5 to lubricate the intake and exhaust camshafts 12In, 12Ex and the intake and exhaust-side rocker shafts 20L, 20R, 21L, 21R which are described above.

In FIG. 1, an oil supply passage T extending from the oil pump 25 to the cylinder head 5 is illustrated by a bold dotted line and a bold one-dot chain line. In the oil supply passage T, a portion illustrated by the bold dotted line is a crankcase-side oil supply passage T1 formed in the crankcase 3 and a portion illustrated by the bold one-dot chain line is a cylinder-side oil supply passage T2 formed in the cylinder block 4 and the cylinder head 5. Description is given below of the crankcase-side oil supply passage T1 and the cylinder-side oil supply passage T2.

First, the crankcase-side oil supply passage T1 has a portion which extends forward and upward from an outlet of the oil pump 25 in the crankcase 3 and is open to the outside of the crankcase 3 to be connected to the oil cooler 26. The portion of the crankcase-side oil supply passage T1 extending from the oil pump 25 to the oil cooler 26 is formed of a hole formed in the crankcase 3. Note that the lubricating oil passing through the oil cooler 26 is cooled and flows downstream.

Next, the crankcase-side oil supply passage T1 has a portion which returns to the upper portion of the crankcase 3 through a hose 27 connecting the oil cooler 26 and the upper portion of the crankcase 3 to each other, extends rearwardly and downwardly from a connection portion of the hose 27, extends upwardly along the cylinder center axis S1 from a portion on the front side of the crankshaft 2 immediately therebehind, and reaches a connection surface (upper surface) of the crankcase 3 with the cylinder block 4 to be opened upwardly.

The portion of the crankcase-side oil supply passage T1 which extends from the oil cooler 26 to the connection surface of the crankcase 3 with the cylinder block 4 is formed of the aforementioned hose 27, a hole formed in the crankcase 3 to extend rearwardly and downwardly from the connection portion of the hose 27, a hole formed in the crankcase 3 to extend upwardly from a rear end portion of the hole extending rearwardly and downwardly.

Lastly, the crankcase-side oil supply passage T1 has a portion which extends rearwardly from an open end of the aforementioned hole extending upwardly in the crankcase 3 and being open on the connection surface of the crankcase 3 with the cylinder block 4 and which is connected to an upstream end portion of the cylinder-side oil supply passage T2. The portion of the crankcase-side oil supply passage T1 which connects the aforementioned open end and the upstream end portion of the cylinder-side oil supply passage T2 to each other is formed of a groove formed on the connection surface of the crankcase 3 with the cylinder block 4 by being recessed downwardly. The groove is formed in an arc shape as viewed in the cylinder center axis S1 direction to avoid the cylinder bore 7.

Note that the portion of the crankcase-side oil supply passage T1 which connects the open end of the hole extending upwardly in the crankcase 3 and being open on the connection surface of the crankcase 3 with the cylinder block 4 and the upstream end portion of the cylinder-side oil supply passage T2 to each other may be formed of a groove formed on a connection surface of the cylinder block 4 with the crankcase 3 by being recessed upwardly.

In the embodiment, the cylinder-side oil supply passage T2 has a main upstream oil supply passage T3 which is connected to the crankcase-side oil supply passage T1 and extends upwardly along the stud bolt 62 to reach a portion below the intake camshaft 12In and a sub upstream oil supply passage T4 which branches off from the middle of the main upstream oil supply passage T3, extends forward, and then extends upwardly to reach a portion below the exhaust camshaft 12Ex.

The main upstream oil supply passage T3 is formed to overlap, in a side view, the stud bolt 62 provided on a rear left side and is formed at a position on the right side of this stud bolt 62.

The sub upstream oil supply passage T4 extends forward substantially orthogonal to an extending direction of the main upstream oil supply passage T3 in a portion in the bottom wall portion of the cylinder head 5 which is located above the combustion chamber 8 and the ignition plug 22, and then extends upwardly from the front wall portion 5F.

The main upstream oil supply passage T3 is formed of a hole extending from a bottom surface of the cylinder block 4 to reach an top surface thereof and a hole formed upward from a bottom surface of the cylinder head 5.

The sub upstream oil supply passage T4 is formed of a hole formed to extend forward from the rear wall portion 5B of the cylinder head 5 and a hole formed to extend upwardly from the bottom surface of the cylinder head 5. Although not illustrated, a lower end of an oil supply passage formed by the hole formed to extend upwardly from the bottom surface of the cylinder head 5 in the sub upstream oil supply passage T4 is closed by a plug member and the top surface of the cylinder block 4. Accordingly, no lubricating oil leaks from the lower end.

The main upstream oil supply passage T3 extends to a position at substantially the same height as positions where the left and right intake-side rocker shafts 20L, 20R are supported, and is connected to an intake-side upstream rocker shaft oil supply passage 30 extending along the direction of the axis C1 of the intake camshaft 12In. The sub-upstream oil supply passage T4 extends to a position at substantially the same height as positions where the left and right exhaust-side rocker shafts 21L, 21R are supported, and is connected to an exhaust-side upstream rocker shaft oil supply passage 31 extending along the direction of the axis C2 of the exhaust camshaft 12Ex.

Accordingly, in the internal combustion engine 1, the intake camshaft 12In, the left intake-side rocker shaft 20L, and the right intake-side rocker shaft 20R are lubricated by the lubricating oil supplied to the intake-side upstream rocker shaft oil supply passage 30 while the exhaust camshaft 12Ex, the left exhaust-side rocker shaft 21L, and the right exhaust-side rocker shaft 21R are lubricated by the lubricating oil supplied to the exhaust-side upstream rocker shaft oil supply passage 31.

Description is given below of configurations of the intake-side upstream rocker shaft oil supply passage 30, the exhaust-side upstream rocker shaft oil supply passage 31, and oil supply passages downstream of these oil supply passages.

Figure 6:
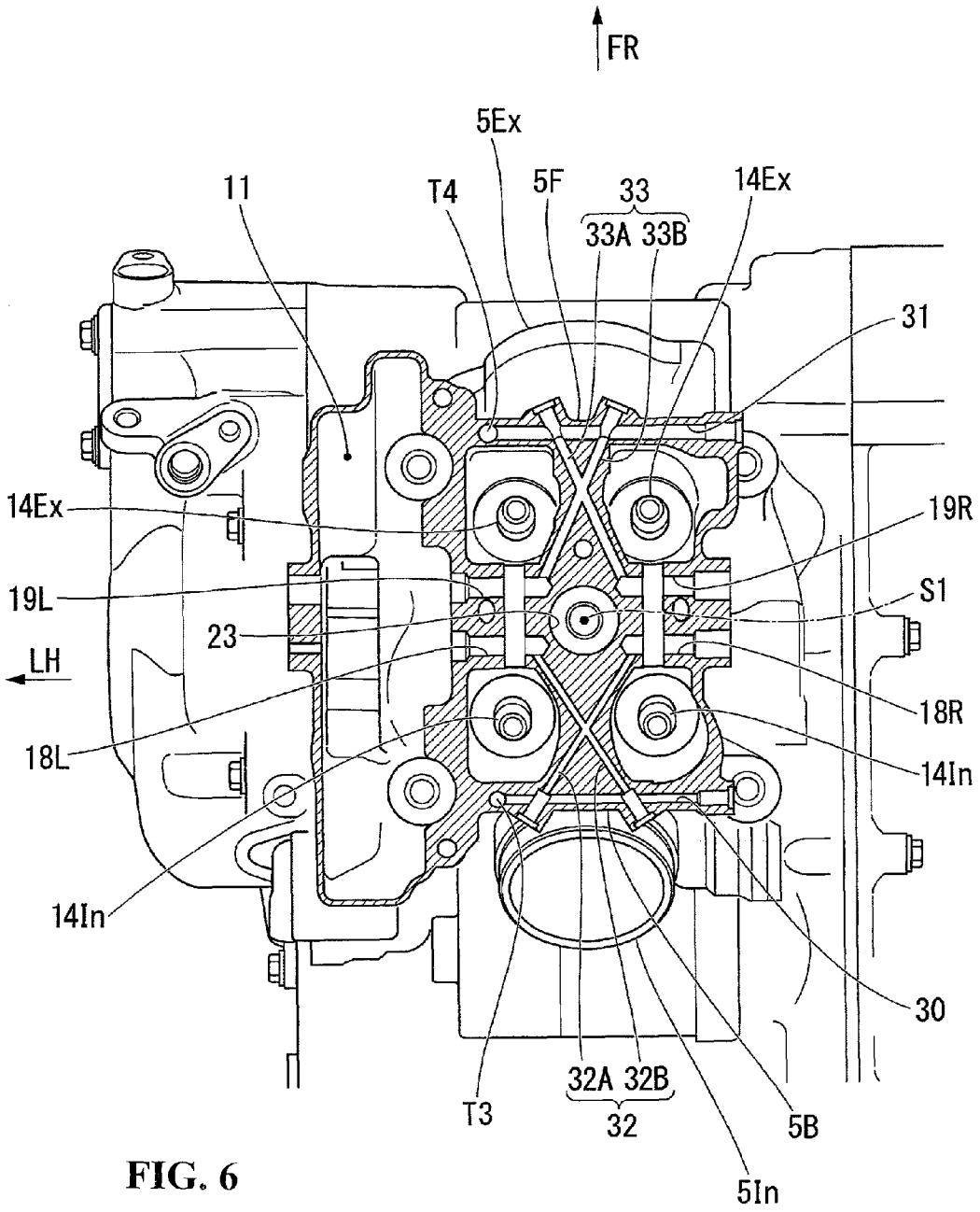
FIG. 6 is a cross-sectional view taken along the I-I line of FIG. 1.

As shown in FIGS. 5 and 6, the main upstream oil supply passage T3 extends in an up-down direction in a left end portion of the rear wall portion 5B and is connected to a left end portion (upstream end portion) of the intake-side upstream rocker shaft oil supply passage 30. The sub upstream oil supply passage T4 extends in the up-down direction in a left end portion of the front wall portion 5F and is connected to a left end portion (upstream end portion) of the exhaust-side upstream rocker shaft oil supply passage 31.

The intake-side upstream rocker shaft oil supply passage 30 is formed of a hole extending leftward from the right wall portion 5R, inside the rear wall portion 5B. The exhaust-side upstream rocker shaft oil supply passage 31 is formed of a hole extending leftward from the right wall portion 5R, inside the front wall portion 5F.

Note that the rear wall portion 5B is located outside the intake valves 14In (exterior side of the cylinder head 5) in a radial direction of the intake camshaft 12In and the front wall portion 5F is located outside the exhaust valves 14Ex in a radial direction of the exhaust camshaft 12Ex.

An intake-side downstream rocker shaft oil supply passage 32 formed in a cross shape by causing two linear portions 32A, 32B to intersect each other is connected to a portion of the intake-side upstream rocker shaft oil supply passage 30 which passes through a connection portion between the rear wall portion 5B and the cam holder 10. An exhaust-side downstream rocker shaft oil supply passage 33 formed in a cross shape by causing two linear portions 33A, 33B to intersect each other is connected to a portion of the exhaust-side upstream rocker shaft oil supply passage 31 which passes through a connection portion between the front wall portion 5F and the cam holder 10.

The lubricating oil is supplied to the left and right intake-side rocker shafts 20L, 20R from the intake-side downstream rocker shaft oil supply passage 32.

In the embodiment, in the intake-side downstream rocker shaft oil supply passage 32, the linear portion 32A extends toward the right side of the attachment hole 23 from a portion of the intake-side upstream rocker shaft oil supply passage 30 which is located on the left side of the attachment hole 23 in the direction of the axis C1 of the intake camshaft 12In, and communicates with the right intake-side support hole 18R. In the intake-side downstream rocker shaft oil supply passage 32, the linear portion 32B extends toward the left side of the attachment hole 23 from a portion of the intake-side upstream rocker shaft oil supply passage 30 which is located on the right side of the attachment hole 23 in the direction of the axis C1 of the intake camshaft 12In, and communicates with the left intake-side support hole 18L.

The lubricating oil can be thus supplied from the intake-side downstream rocker shaft oil supply passage 32 to the left and right intake-side rocker shafts 20L, 20R.

As is apparent from FIG. 6, in the embodiment, the intake-side upstream rocker shaft oil supply passage 30 and the intake-side downstream rocker shaft oil supply passage 32 are formed on the same plane orthogonal to the cylinder center axis S1. The intake-side downstream rocker shaft oil supply passage 32 is formed of a hole extending obliquely to the right and forward from the rear wall portion 5B and a hole extending obliquely to the left and forward from the rear wall portion 5B.

As shown in FIG. 5, the intake camshaft bearing portion 10In is located above a cross portion Cr1 of the intake-side downstream rocker shaft oil supply passage 32 in the cam holder 10, and an intake-side cam oil supply passage 34 extending upwardly from the cross portion Cr1 to the intake camshaft bearing portion 10In is formed in the cam holder 10.

Part of the lubricating oil flowing into the intake-side downstream rocker shaft oil supply passage 32 thereby flows into the intake-side cam oil supply passage 34 from the cross portion Cr1. The lubricating oil can be thus supplied to the intake camshaft bearing portion 10In.

Note that the description of the exhaust-side downstream rocker shaft oil supply passage 33 on the exhaust side is omitted because the configuration thereof is front-rear symmetric to the configuration of the intake-side downstream rocker shaft oil supply passage 32. In the drawing, a cross portion Cr2 of the exhaust-side downstream rocker shaft oil supply passage 33 is provided with an exhaust-side cam oil supply passage 35 extending from the cross portion Cr2.

In the embodiment, as is apparent from FIGS. 5 and 6, the attachment hole 23 is provided to extend from the center portion of the cam holder 10 in the front-rear direction to the combustion chamber 8 and part of the attachment hole 23 is located between a connection portion between the left intake-side support hole 18L on the left side of the attachment hole 23 in the direction of the axis C1 of the intake camshaft 12In and the linear portion 32B of the downstream rocker shaft oil supply passage 32 and a connection portion between the right intake-side support hole 18R on the right side of the attachment hole 23 and the linear portion 32A of the downstream rocker shaft oil supply passage 32.

Note that description of a positional relationship among the left exhaust-side support hole 19L, the right exhaust-side support hole 19R, and the attachment hole 23 on the exhaust side is omitted because the positional relationship is similar to that on the intake side and is front-rear symmetric thereto.

As described above, in the internal combustion engine 1 of the embodiment, the intake-side upstream rocker shaft oil supply passage 30 extending in the direction of the axis C1 of the intake camshaft 12In is formed in the rear wall portion 5B which is located outside the intake valves 14In in the radial direction of the intake camshaft 12In in the cylinder head 5 and which is located outside (behind) the cylinder center axis S1 as viewed in the cylinder center axis S1 direction. The exhaust-side upstream rocker shaft oil supply passage 31 extending in the direction of the axis C2 of the exhaust camshaft 12Ex is formed in the front wall portion 5F which is located outside the exhaust valves 14Ex in the radial direction of the exhaust camshaft 12Ex in the cylinder head 5 and which is located outside (in front of) the cylinder center axis S1 as viewed in the cylinder center axis S1 direction.

The cam holder 10 extends from the rear wall portion 5B and the front wall portion 5F toward the attachment hole 23 as viewed in the cylinder center axis S1 direction. In addition, the cam holder 10 extends orthogonally to the intake camshaft 12In and the exhaust camshaft 12Ex as viewed in the cylinder center axis S1 direction. Furthermore, inside the cam holder 10, there are formed the intake-side downstream rocker shaft oil supply passage 32 formed in the cross shape by causing the two linear portions 32A, 32B to intersect each other and the exhaust-side downstream rocker shaft oil supply passage 33 formed in the cross shape by causing the two linear portions 33A, 33B to intersect each other.

In the intake-side downstream rocker shaft oil supply passage 32, the linear portion 32B out of the linear portions 32A, 32B extends from the intake-side upstream rocker shaft oil supply passage 30 toward the left side of the attachment hole 23 in the direction of the axis C1 of the intake camshaft 12In, and communicates with the left intake-side support hole 18L which is located on the left side of the attachment hole 23 and which supports the left intake-side rocker shaft 20L. The linear portion 32A out of the linear portions 32A, 32B extends from the intake-side upstream rocker shaft oil supply passage 30 toward the right side of the attachment hole 23 in the direction of the axis C1 of the intake camshaft 12In, and communicates with the right intake-side support hole 18R which is located on the right side of the attachment hole 23 and which supports the right intake-side rocker shaft 20R.

In the exhaust-side downstream rocker shaft oil supply passage 33, the linear portion 33B out of the linear portions 33A, 33B extends from the exhaust-side upstream rocker shaft oil supply passage 31 toward the left side of the attachment hole 23 in the direction of the axis C2 of the exhaust camshaft 12Ex, and communicates with the left exhaust-side support hole 19L which is located on the left side of the attachment hole 23 and which supports the left exhaust-side rocker shaft 21L. The linear portion 33A out of the linear portions 33A, 33B extends from the exhaust-side upstream rocker shaft oil supply passage 31 toward the right side of the attachment hole 23 in the direction of the axis C2 of the exhaust camshaft 12Ex, and communicates with the right exhaust-side support hole 19R which is located on the right side of the attachment hole 23 and which supports the right exhaust-side rocker shaft 21R.

In the internal combustion engine 1 described above, it is possible to distribute and supply the lubricating oil to the rocker shafts (20L, 20R, 21L, 21R) located on the left and right sides of the attachment hole 23 for the ignition plug 22 in the directions of the axis C1 of the intake camshaft 12In and the axis C2 of the exhaust camshaft 12Ex by using the simple-shaped intake-side downstream rocker shaft oil supply passage 32 and exhaust-side downstream rocker shaft oil supply passage 33 which are formed inside the cam holder 10 and which have the cross shapes. Since the intake-side downstream rocker shaft oil supply passage 32 and the exhaust-side downstream rocker shaft oil supply passage 33 each have the cross shape, it possible to make the passage lengths of the two linear portions (32A, 32B, 33A, 33B) extending toward the left and right sides of the attachment hole 23 uniform and short, and to supply the lubricating oil to the rocker shafts (20L, 20R, 21L, 21R) located on the left and right sides of the attachment hole 23.

Due to this, in the internal combustion engine 1, while the shape of the oil supply passages to the rocker shafts is simple, it is possible to secure a sufficient amount of lubricating oil for the rocker shafts. Accordingly, size reduction and an improvement in production efficiency can be achieved while securing a sufficient amount of lubricating oil for the rocker shafts.

The embodiment of the present invention has been described above. However, the present invention is not limited to the embodiment described above and various changes can be made within a scope not departing from the spirit of the present invention.

For example, in the aforementioned embodiment, a description is provided of the case where the left intake-side rocker shaft 20L and the right intake-side rocker shaft 20R are arranged on the left and right sides of the attachment hole 23 in a distributed manner and the left exhaust-side rocker shaft 21L and the right exhaust-side rocker shaft 21R are arranged on the left and right sides of the attachment hole 23 in a distributed manner. However, as a modified example, a rocker shaft may extend on both of the left and right sides of the attachment hole 23.

In the aforementioned embodiment, a description is provided of an example in which the intake-side upstream rocker shaft oil supply passage 30 and the intake-side downstream rocker shaft oil supply passage 32 are provided on the intake side and the exhaust-side upstream rocker shaft oil supply passage 31 and the exhaust-side downstream rocker shaft oil supply passage 33 are provided on the exhaust side. As a modified example, the intake-side upstream rocker shaft oil supply passage 30 and the intake-side downstream rocker shaft oil supply passage 32 may be provided only on the intake side or the exhaust-side upstream rocker shaft oil supply passage 31 and the exhaust-side downstream rocker shaft oil supply passage 33 may be provided only on the exhaust side.

In the aforementioned embodiment, a description is provided of the configuration in which the ignition plug 22 is provided in the substantial center of the combustion chamber 8. However, the internal combustion engine of the present invention may be a diesel engine in which a fuel injection valve is provided in the substantial center of the combustion chamber 8. Although a description of the DOHC internal combustion engine 1 is given in the aforementioned embodiment, the internal combustion engine of the present invention may be a SOHC internal combustion engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a plurality of valves provided in a valve chamber formed in a cylinder head;

a cam holder provided in the valve chamber;

a camshaft rotatably supported by the cam holder and having cams configured to open and close the plurality of valves via rocker arms;

an attachment hole for an ignition plug or a fuel injection valve, the attachment hole formed to communicate with a substantial center of a combustion chamber; and rocker shafts configured to support the rocker arms, the rocker shafts being parallel to a direction of an axis of the camshaft and arranged in a distributed manner on one side and another side of the attachment hole, wherein:

the cam holder extends from a wall portion of the cylinder head toward the attachment hole;

a downstream rocker shaft oil supply passage formed in a cross shape by causing two linear portions to intersect each other is formed inside the cam holder; and in the downstream rocker shaft oil supply passage, one of the linear portions extends toward the one side of the attachment hole and communicates with a support hole located on the one side of the attachment hole and configured to support the corresponding rocker shaft, while the other one of the linear portions extends toward the other side of the attachment hole and communicates with a support hole located on the other side of the attachment hole and configured to support the corresponding rocker shaft.

2. The internal combustion engine according to claim 1, wherein:

the rocker shafts support the rocker arms on one side and another side of the attachment hole in the direction of the axis of the camshaft in such a way that the rocker arms are swingable, and the rocker arms are in contact with the plurality of valves arranged on the one side and the other side of the attachment hole in the direction of the axis of the camshaft;

an upstream rocker shaft oil supply passage extending in the direction of the axis of the camshaft is formed in the wall portion of the cylinder head; and the downstream rocker shaft oil supply passage extends from the upstream rocker shaft oil supply passage.

3. The internal combustion engine according to claim 1, wherein:

the rocker shafts are arranged in a distributed manner on one side and another side of the attachment hole in the direction of the axis of the camshaft;

the attachment hole is provided to extend from the cam holder to the combustion chamber; and at least part of the attachment hole is located between a connection portion between the support hole on the one side of the attachment hole in the direction of the axis of the camshaft and the downstream rocker shaft oil supply passage and a connection portion between the support hole on the other side and the downstream rocker shaft oil supply passage.

4. The internal combustion engine according to claim 2, wherein:

the rocker shafts are arranged in a distributed manner on one side and another side of the attachment hole in the direction of the axis of the camshaft;

the attachment hole is provided to extend from the cam holder to the combustion chamber; and at least part of the attachment hole is located between a connection portion between the support hole on the one side of the attachment hole in the direction of the axis of the camshaft and the downstream rocker shaft oil supply passage and a connection portion between the support hole on the other side and the downstream rocker shaft oil supply passage.

5. The internal combustion engine according to claim 1, wherein:

a bearing portion of the camshaft is formed above a cross portion of the downstream rocker shaft oil supply passage in the cam holder; and a cam oil supply passage extending from the cross portion to the bearing portion is formed in the cam holder.

6. The internal combustion engine according to claim 2, wherein:

a bearing portion of the camshaft is formed above a cross portion of the downstream rocker shaft oil supply passage in the cam holder; and a cam oil supply passage extending from the cross portion to the bearing portion is formed in the cam holder.

7. The internal combustion engine according to claim 3, wherein:

a bearing portion of the camshaft is formed above a cross portion of the downstream rocker shaft oil supply passage in the cam holder; and a cam oil supply passage extending from the cross portion to the bearing portion is formed in the cam holder.

8. The internal combustion engine according to claim 4, wherein:

a bearing portion of the camshaft is formed above a cross portion of the downstream rocker shaft oil supply passage in the cam holder; and a cam oil supply passage extending from the cross portion to the bearing portion is formed in the cam holder.

9. The internal combustion engine according to claim 2, wherein:

an upstream oil supply passage is formed at least in the cylinder head, the upstream oil supply passage extending along a fastening member provided to extend across a crankcase, a cylinder block standing upright from the crankcase, and the cylinder head standing upright from the cylinder block;

the upstream rocker shaft oil supply passage is connected to a downstream end portion of the upstream oil supply passage; and the upstream rocker shaft oil supply passage and the downstream rocker shaft oil supply passage are formed on a plane orthogonal to the a cylinder center axis.

10. The internal combustion engine according to claim 1, wherein:

the internal combustion engine is a four-valve engine in which the plurality of valves configured to open and close a single one of the combustion chamber include two intake valves and two exhaust valves; and the rocker arms corresponding to the single combustion chamber include two intake rocker arms configured to open and close the intake valves and two exhaust rocker arms configured to open and close the exhaust valves;

the camshaft includes an intake camshaft configured to swing the intake rocker arms and an exhaust camshaft configured to swing the exhaust rocker arms;

the intake rocker arms and the exhaust rocker arms are each orthogonal to a direction of an axis of the intake camshaft or the exhaust camshaft and are arranged in a distributed manner on one side and another side of the attachment hole in a direction orthogonal to a cylinder center axis; and the downstream rocker shaft oil supply passage includes an intake-side downstream rocker shaft oil supply passage and an exhaust-side downstream rocker shaft oil supply passage.

11. An internal combustion engine comprising:

a cylinder head including a valve chamber;

a plurality of valves operatively mounted in the valve chamber formed in the cylinder head;

a plurality of cams each operatively positioned relative to one of said plurality of valves;

a cam holder provided in the valve chamber;

a camshaft rotatably supported by the cam holder with each of said plurality of cams configured to open and close each of the plurality of valves via rocker arms;

an attachment hole for an ignition plug or a fuel injection valve, the attachment hole formed to communicate with a substantial center of a combustion chamber; and rocker shafts configured to support the rocker arms, the rocker shafts being parallel to a direction of an axis of the camshaft and arranged in a distributed manner on one side and another side of the attachment hole, wherein:

the cam holder extends from a wall portion of the cylinder head toward the attachment hole;

a downstream rocker shaft oil supply passage formed in a cross shape by causing two linear portions to intersect each other is formed inside the cam holder; and in the downstream rocker shaft oil supply passage, one of the linear portions extends toward the one side of the attachment hole and communicates with a support hole located on the one side of the attachment hole and configured to support the corresponding rocker shaft, while the other one of the linear portions extends toward the other side of the attachment hole and communicates with a support hole located on the other side of the attachment hole and configured to support the corresponding rocker shaft.

12. The internal combustion engine according to claim 11, wherein:

the rocker shafts support the rocker arms on one side and another side of the attachment hole in the direction of the axis of the camshaft wherein the rocker arms are swingable, and the rocker arms are in contact with the plurality of valves arranged on the one side and the other side of the attachment hole in the direction of the axis of the camshaft;

an upstream rocker shaft oil supply passage extending in the direction of the axis of the camshaft is formed in the wall portion of the cylinder head; and the downstream rocker shaft oil supply passage extends from the upstream rocker shaft oil supply passage.

13. The internal combustion engine according to claim 11, wherein:

the rocker shafts are arranged in a distributed manner on one side and another side of the attachment hole in the direction of the axis of the camshaft;

the attachment hole is provided to extend from the cam holder to the combustion chamber; and at least part of the attachment hole is located between a connection portion between the support hole on the one side of the attachment hole in the direction of the axis of the camshaft and the downstream rocker shaft oil supply passage and a connection portion between the support hole on the other side and the downstream rocker shaft oil supply passage.

14. The internal combustion engine according to claim 12, wherein:

the rocker shafts are arranged in a distributed manner on one side and another side of the attachment hole in the direction of the axis of the camshaft;

the attachment hole is provided to extend from the cam holder to the combustion chamber; and at least part of the attachment hole is located between a connection portion between the support hole on the one side of the attachment hole in the direction of the axis of the camshaft and the downstream rocker shaft oil supply passage and a connection portion between the support hole on the other side and the downstream rocker shaft oil supply passage.

15. The internal combustion engine according to claim 11, wherein:

a bearing portion of the camshaft is formed above a cross portion of the downstream rocker shaft oil supply passage in the cam holder; and a cam oil supply passage extending from the cross portion to the bearing portion is formed in the cam holder.

16. The internal combustion engine according to claim 12, wherein:

a bearing portion of the camshaft is formed above a cross portion of the downstream rocker shaft oil supply passage in the cam holder; and a cam oil supply passage extending from the cross portion to the bearing portion is formed in the cam holder.

17. The internal combustion engine according to claim 13, wherein:

a bearing portion of the camshaft is formed above a cross portion of the downstream rocker shaft oil supply passage in the cam holder; and a cam oil supply passage extending from the cross portion to the bearing portion is formed in the cam holder.

18. The internal combustion engine according to claim 14, wherein:

a bearing portion of the camshaft is formed above a cross portion of the downstream rocker shaft oil supply passage in the cam holder; and a cam oil supply passage extending from the cross portion to the bearing portion is formed in the cam holder.

19. The internal combustion engine according to claim 12, wherein:

an upstream oil supply passage is formed at least in the cylinder head, the upstream oil supply passage extending along a fastening member provided to extend across a crankcase, a cylinder block standing upright from the crankcase, and the cylinder head standing upright from the cylinder block;

the upstream rocker shaft oil supply passage is connected to a downstream end portion of the upstream oil supply passage; and the upstream rocker shaft oil supply passage and the downstream rocker shaft oil supply passage are formed on a plane orthogonal to the a cylinder center axis.

20. The internal combustion engine according to claim 11, wherein:

the internal combustion engine is a four-valve engine in which the plurality of valves configured to open and close a single one of the combustion chamber include two intake valves and two exhaust valves; and the rocker arms corresponding to the single combustion chamber include two intake rocker arms configured to open and close the intake valves and two exhaust rocker arms configured to open and close the exhaust valves;

the camshaft includes an intake camshaft configured to swing the intake rocker arms and an exhaust camshaft configured to swing the exhaust rocker arms;

the intake rocker arms and the exhaust rocker arms are each orthogonal to a direction of an axis of the intake camshaft or the exhaust camshaft and are arranged in a distributed manner on one side and another side of the attachment hole in a direction orthogonal to a cylinder center axis; and the downstream rocker shaft oil supply passage includes an intake-side downstream rocker shaft oil supply passage and an exhaust-side downstream rocker shaft oil supply passage.

* * * * *